US007142085B2

(12) United States Patent
Phadke

(10) Patent No.: US 7,142,085 B2
(45) Date of Patent: Nov. 28, 2006

(54) INSULATION AND INTEGRATED HEAT SINK FOR HIGH FREQUENCY, LOW OUTPUT VOLTAGE TOROIDAL INDUCTORS AND TRANSFORMERS

(75) Inventor: Vijay Gangadhar Phadke, Pasig (PH)

(73) Assignee: Astec International Limited, Hong Kong (HK)

( * ) Notice: Subject to any disclaimer, the term of this patent is extended or adjusted under 35 U.S.C. 154(b) by 70 days.

(21) Appl. No.: 10/688,127

(22) Filed: Oct. 17, 2003

(65) Prior Publication Data

US 2004/0080393 A1 Apr. 29, 2004

Related U.S. Application Data

(60) Provisional application No. 60/419,877, filed on Oct. 18, 2002.

(51) Int. Cl.
*H01F 27/28* (2006.01)

(52) U.S. Cl. ..... 336/229; 336/182; 336/181

(58) Field of Classification Search ..... 336/61, 336/180, 229, 223, 178, 65, 198, 200, 83, 336/182; 29/602.1, 606
See application file for complete search history.

(56) References Cited

U.S. PATENT DOCUMENTS 4,551,700 A 11/1985 Waldemar ..... 336/192
4,811,477 A * 3/1989 Sylvester et al. ..... 29/605
5,128,511 A * 7/1992 Stanisz ..... 219/116
5,264,803 A * 11/1993 Mayfield ..... 330/124 R
5,546,065 A * 8/1996 Vinciarelli et al. ..... 336/84 C
5,618,455 A * 4/1997 Guo ..... 219/130.1
5,684,678 A * 11/1997 Barrett ..... 363/17
5,838,220 A 11/1998 Hagberg ..... 336/206
6,275,132 B1 * 8/2001 Shikama et al. ..... 336/83
6,300,857 B1 10/2001 Herwig ..... 336/229
6,457,464 B1 * 10/2002 Rapoport et al. ..... 123/605
6,538,863 B1 3/2003 Macbeth ..... 361/42
6,642,827 B1 * 11/2003 McWilliams et al. ..... 336/107
6,762,666 B1 * 7/2004 Chu ..... 336/229
2003/0183620 A1 * 10/2003 Wong ..... 219/549

* cited by examiner

*Primary Examiner*—Anh Mai
(74) *Attorney, Agent, or Firm*—Nixon Peabody LLP

(57) ABSTRACT

Toroidal transformer and inductor configurations are described that allow for greater heat transfer away from internal device components. The inventive transformer allows for higher thermal and electrical efficiency, as well as for more efficient use of expensive components, such as copper wire. In one embodiment, a toroidal transformer provides access for cooling air by forming the primary winding from a single layer of thick wire and a secondary winding of few turns such that most of the primary winding is exposed to air flow. In another embodiment, a heat sink is positioned between the core and primary windings to conduct heat away from the transformer.

19 Claims, 6 Drawing Sheets

INSULATION AND INTEGRATED HEAT SINK FOR HIGH FREQUENCY, LOW OUTPUT VOLTAGE TOROIDAL INDUCTORS AND TRANSFORMERS

CROSS REFERENCE TO RELATED APPLICATION

This application claims the benefit of U.S. provisional application Ser. No. 60/419,877, filed Oct. 18, 2002.

FIELD OF THE INVENTION

The present invention relates to devices having toroidal cores, such as inductors and transformers and, in particular to transformers having an integrated heat sink.

BACKGROUND OF THE INVENTION

Conventional bobbin-wound transformers are used in many electronic devices. Bobbin-wound transformers, which are generally formed by winding conductive wires having insulating layers about a bobbin, are simple in construction and have adequate performance for many applications. However, bobbin-wound transformers have several limitations. Several of these limitations result from the difficulty in removing heat from the transformers. Insulating layers that cover the winding wires hinder conduction of heat from the wires, while the windings interfere with air flow to inner layers of the windings and thus decrease convective heat transfer. As a result of problems with cooling bobbin-wound transformers, there are electrical conversion and material use inefficiencies that either limit the use or operation of these transformers, limit the power density, or require more space or additional resources to provide adequate cooling. Toroidal transformers have been developed to address the problems with bobbin-wound transformers, but these too have problems.

More specifically, it is well known in high frequency switching power supply applications to use the popular geometry of ferrite cores, e.g., EE, EI, PQ, ETD, EC, RM, and similar type of cores, in conjunction with the use of an insulating bobbin to position the windings. However, the resulting transformers have serious problems in modern high density switching power supply applications. Such transformers are bulky and are difficult to cool. Usually the innermost winding is buried under several layers of insulation and thus suffers the most from the latter disadvantage, i.e., the heat transfer mechanism of such a construction is through all of the other upper windings and insulation layers. This type of transformer has extremely high thermal resistance to ambient and needs to use over-sized copper wiring to meet hot spot temperature limits. Its performance improves only marginally by impregnating the transformer with varnish or some other filler.

The use of toroidal transformers is an effective solution to answer power density and thermal issues. However, the biggest problem in prior art toroidal transformers is the high potential safety insulation between the primary and the secondary low voltage windings. For example, U.S. Pat. Nos. 4,551,700, 5,838,220, and 6,300,857 each suggest methods to meet these safety insulation needs. These prior art methods still seriously affect the manufacturing yield in high volume applications. Applying insulation layers over the primary winding using an insulation tape or film is too cumbersome while using a sleeve on one of the windings is still time consuming.

A toroidal transformer constructed using techniques suggested in above-mentioned prior art still also has thermal limitations. Inherently, most of the windings of the toroidal transformer are exposed to ambient air depending upon the insulation method. An insulating cap or a sleeve on the winding increases its thermal resistance to ambient. Using triple insulated wires is not a viable option due to the difficulty faced in winding the wires on toroids because of the spring-back effect that occurs during winding.

What is needed is a transformer having improved thermal performance. What is also needed is a transformer having improved power density. It is also desirable to have a transformer with a smaller footprint than conventional bobbin-wound transformers. In addition, it is desirable for the transformer to use less material than conventional bobbin-wound transformers.

SUMMARY OF THE INVENTION

The present invention solves the above-identified problems of known transformers through the use of toroidal-shaped transformers. In the transformer of the present invention, the majority of the windings are more easily accessible to cooling air than in bobbin-wound transformers, allowing for more efficient cooling of the windings. Broadly stated, the present invention comprises a transformer having a toroidal core, a primary winding wrapped about the toroidal core as a spaced single layer of wire, and a secondary winding wrapped about the primary winding to form a helix.

In one embodiment of the present invention, a copper strap heat sink is positioned between the toroidal core and the windings to provide additional cooling of the transformer. In addition to conducting heat from the windings and core, the copper strap heat sink can also conduct heat away from the transformer by means of either a cooling air flow or an external heat sink.

It is one advantage of the present invention to provide a transformer with improved thermal performance.

It is another advantage of the present invention to provide a transformer having improved power densities.

It is yet another advantage of the present invention to provide a transformer that can be adapted to have a variety of foot prints.

It is an advantage of the present invention to provide a transformer that uses less copper than conventional bobbin-wound transformers while providing sufficient cooling to the windings and core of the transformer.

It is yet another advantage of the present invention to provide a transformer that can be constructed for lower cost than bobbin-wound transformers.

It is another advantage of the present invention to provide a transformer having high conversion efficiencies.

It is an advantage of the present invention to provide a transformer having one primary winding layer, thus reducing proximity effect losses at high operating frequencies.

It is a further advantage of the present invention to provide a transformer that meets or exceeds SELV safety creepage and clearance requirements.

A further understanding of the invention can be had from the detailed discussion of the specific embodiment below. For purposes of clarity, this discussion refers to devices, methods, and concepts in terms of specific examples. However, the method of the present invention may be used to connect a wide variety of types of devices. It is therefore intended that the invention not be limited by the discussion of specific embodiments.

BRIEF DESCRIPTION OF THE DRAWINGS

The foregoing aspects and the attendant advantages of the present invention will become more readily appreciated by reference to the following detailed description, when taken in conjunction with the accompanying drawings, wherein:

FIG. 8*a* is a top edge and left side perspective view and FIG. 8*b* is a right side view;

Reference symbols or names are used in the figures to indicate certain components, aspects or features shown therein, with reference symbols common to more than one figure indicating like components, aspects or features shown therein.

DETAILED DESCRIPTION OF THE INVENTION

To facilitate its description, the invention is described below in terms of specific embodiments, and with reference to the figures, directed to a high frequency switching power supply transformer having a large number of primary turns and relatively low number of secondary turns. The inventive toroidal configuration can be used in all switching power supply applications, switching in a wide range of frequencies, and can be applied to power transformers and inductors, as well as EMI filters.

Figure 1A:
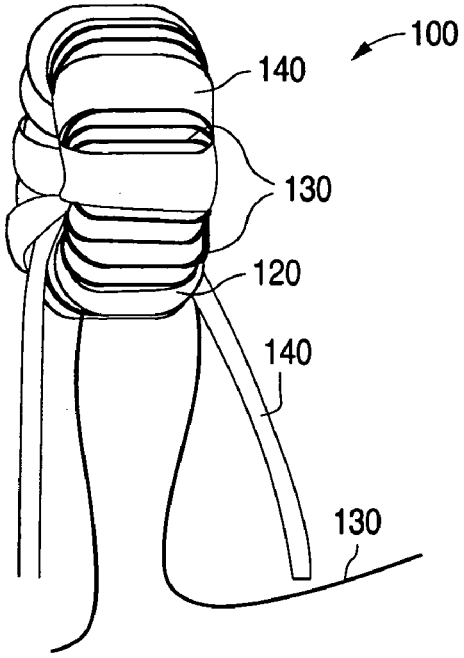
FIGS. 1*a* and 1*b* show an edge perspective view and a left side perspective view, respectively, of a first embodiment of a toroidal transformer according to the present invention.
Figure 1B:
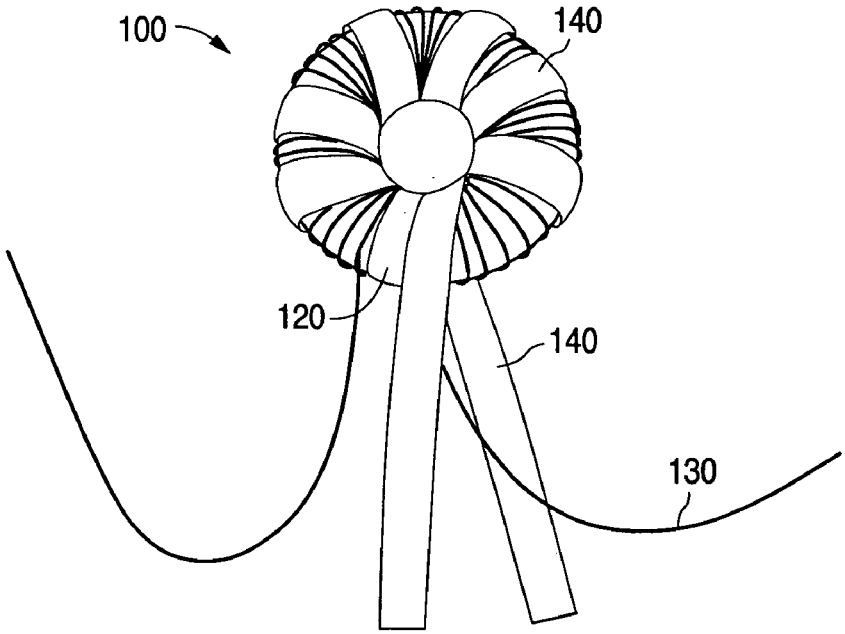

A first embodiment of a toroidal transformer according to the present invention is now described with reference to FIGS. 1–5. FIGS. 1*a* and 1*b* are edge and left side perspective views, respectively, of a toroidal transformer 100. FIGS. 1*a* and 1*b* show primary winding 130 and a secondary winding 140 wrapped around the primary wiring to form a spiral or helix. Transformer 100 is particularly well suited for applications where sufficient air flow is available, as both the primary and secondary windings 130 and 140 are located about the outer surface of transformer 100. In addition, transformer 100 offers extremely low leakage inductance and inter-winding capacitance, and has a very small footprint.

Figures 2A, 2B:
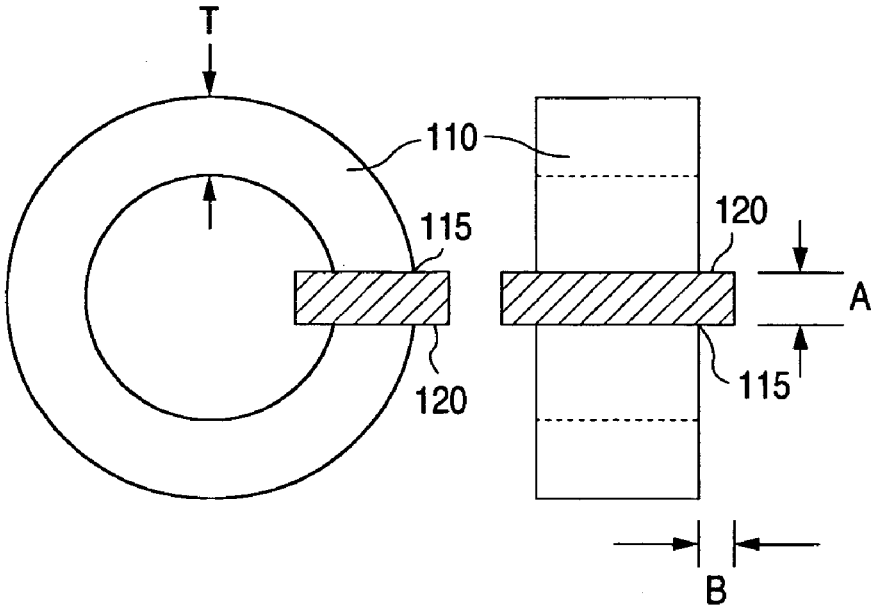
FIGS. 2*a* and 2*b* show a left side view and a top edge view, respectively, of the core of a toroidal transformer according to the present invention.

FIGS. 2*a* and 2*b* show a left side view and a top edge view, respectively, of the innermost portions of toroidal transformer 100 of the present invention. A suitable sized coated toroidal core 110 is selected to accommodate the required electrical ratings, frequency range and power handling capacity of transformer 100. Core 110 has a thickness "T" and an insulation layer coating (not shown) which meets the basic insulation requirements of various safety agencies. A margin tape 120 of width "A" and thickness "B" is applied to a toroidal section 115 of core 110, as shown in FIGS. 2*a* and 2*b*. The width "A" is selected based upon the working voltage across primary winding 130. The thickness "B" is selected to be taller than the wires of primary winding 130 (as seen in FIG. 3).

Figure 3:
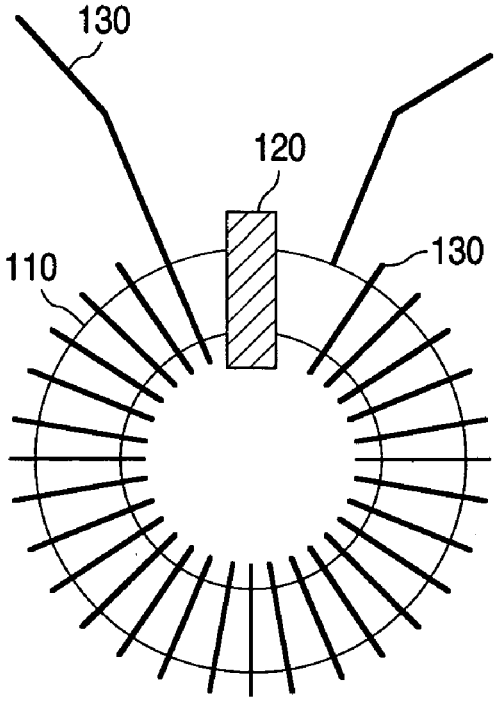
FIG. 3 is a side view of the primary winding wrapped about the core of the toroidal transformer according to the present invention.

FIG. 3 is side view of the primary winding wound about the core 110 of toroidal transformer 100. The inner and outer diameters of core 110 are selected to accommodate all turns of primary winding 130 in one layer after application of margin tape 120 to the core 110. In the preferred embodiment, secondary turns are few such that most of the primary wiring is directly exposed to air flow. As a result, the wire used to form primary winding 130 can be sized quite aggressively. It is preferred that primary winding 130 is wound using a thick magnet wire to produce a well spaced, single layer winding. An example of a suitable magnet wire is FORMVAR, a polyvinyl resin coated copper wire that can be purchased from Femco Magnet Wire Company ranging in size from 0.6 to 3.2 mm. A single layer primary winding substantially reduces the interlayer proximity effect. The use of bunches of twisted wires is not recommended for this embodiment. Although twisted wires have lower AC resistance due to lower skin effect losses, the close packing of wires presents cooling problems. Additionally, the use of thicker wires provides better thermal performance. A preferred thickness is in the range of about 0.5 mm to about 4 mm.

Figure 4A:
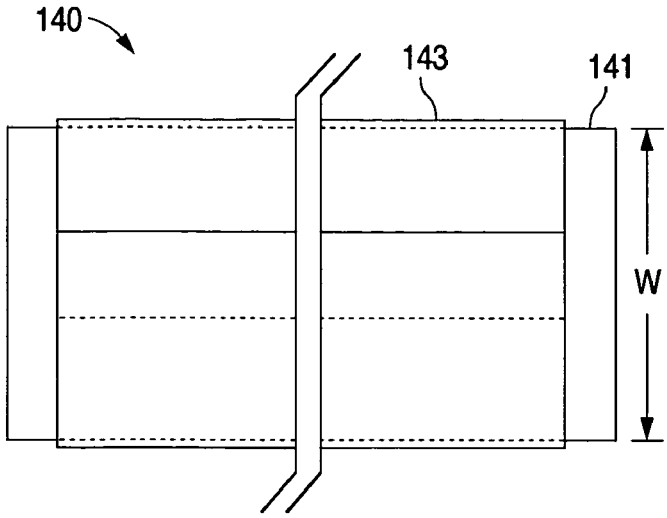
FIGS. 4*a* and 4*b* show a plan view and an end view, respectively, of a preferred embodiment of the secondary winding of the toroidal transformer of the present invention after the application of one layer of insulation.
Figure 4B:
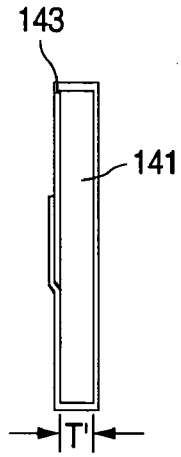

FIGS. 4*a* and 4*b* show a plan view and an end view, respectively, of secondary winding 140 of toroidal transformer 100 according to the present invention after the application of one layer of insulation 143. Secondary winding 140, shown in FIGS. 4*a* and 4*b*, is illustrated in a shape prior to being wound about primary winding 130 and core 110. As shown in FIGS. 4*a* and 4*b*, secondary winding 140 is formed from a copper strip 141 of suitable width "W" and thickness "$T^1$" for winding about core 110 and primary winding 130. In general, smaller cores can use only smaller "W" and "$T^1$" dimensions while larger cores can accept larger "W" and "$T^1$" dimensions. The proper selection of copper strip 141 takes into account the flexibility of copper strip, the size of core 110, and the ratio $W/T^1$. A toroidal core 110 having an inner diameter of 18 mm and an outer diameter of 28 mm can accept either a copper strip having a width of 5 mm and a thickness of 0.4 mm or a copper strip having a width of 7 mm and thickness of 0.3 mm. Therefore, a preferred $W/T^1$ is in the range about 5 to about 30. Due to fewer secondary turns, the length of this copper strip is usually very small. The length of copper strip 141 is selected according to the number of secondary turns desired. The ends of copper strip 141 should be free of burrs. Insulation tape 143 is applied with overlapping edges to effectively insulate copper strip 141.

Figure 5:
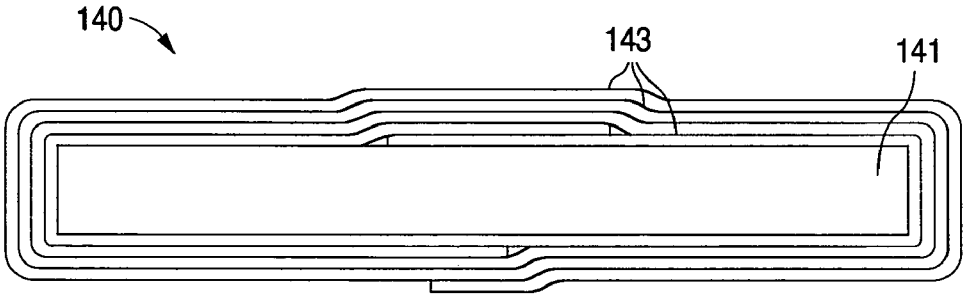
FIG. 5 shows an end view of the secondary winding of the toroidal transformer of the present invention surrounded by a plurality of insulating layers prior to its being wound about the transformer core.

A plurality of insulating tape layers 143 are preferably included on copper strip 141, as shown in FIG. 5. Specifically, FIG. 5 shows a total of four layers 143 on copper strip 141. This forms a reinforced insulation layer between the primary and SELV (Safety Extra Low Voltage) secondary circuits, as required by various safety agencies. Alternatively, a single layer could also be used if a tape sleeve or tube qualified as a reinforced insulator is used. Tape layers are preferred to a sleeve or tube, as the latter creates air pockets which make it more difficult to cool the secondary winding. Application of insulation tape 143 is easily done by an automated process.

Alternatively, for a higher secondary current rating, the number of secondary winding insulated strips could be stacked together, depending upon the current rating of the secondary winding. The insulating layers could be thick, as this is a top-most winding and is almost fully exposed to air flow for cooling. The number of strips stacked is dictated by the dimensions of the toroid and winding comfort.

The ends of both primary and secondary windings can be terminated using a suitable toroidal base, while maintaining the safety creepage/clearance between the terminations. Alternatively, the secondary winding could be terminated at the base while the primary is terminated through flexible wires on the top edge of the transformer. Several possibilities exist for these terminations, depending upon the application and packaging constraints.

If few secondary turns are required, such as one or two turns, then several one-turn loops could be used adjacent to each other and parallel on a printed circuit board upon termination. Alternatively, for some applications, such as very low output voltage applications, insulated "U" shaped copper bus bars can be used for terminating the windings. Such constructions would need a clearance around the transformer as the body of it could be treated as primary side due to exposed primary winding.

A preferred cooling arrangement of transformer 100 of the present invention directs an air flow through the center of the toroid. This arrangement effectively cools all windings as well as the exposed core. It is noted that, due to a well-spaced primary winding 130, core 110 is substantially exposed on its outer diameter. Also, due to fewer well spaced turns on the secondary winding 140, core 110 is exposed to sufficient cooling air. This assembly could be lightly varnished to reduce acoustic vibration of the windings.

A second embodiment of the present invention is now described with reference to FIGS. 6–9, shown as toroidal transformer 200. FIGS. 6, 7, 8*a* and 8*b* show various stages of the transformer during the method of forming the structure of transformer 200. The sequence of steps shown is for illustrative purposes, and is not meant to limit the scope of the invention. Core 110 is selected according to performance requirements, as previously described. The second embodiment includes a heat sink 250 adjacent to coil 110 to conduct heat away from the core and windings.

Figure 6A:
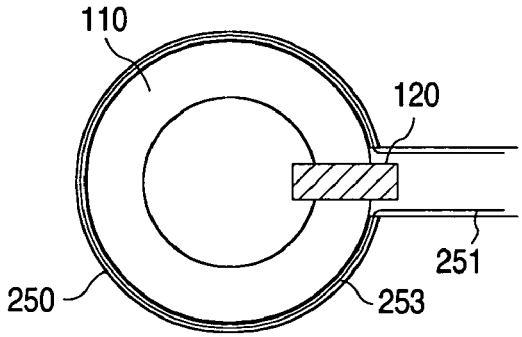
FIGS. 6*a* and 6*b* show a left side view and a top edge view, respectively, of a second embodiment of the toroidal transformer with a heat sink wrapped about the core according to the present invention.
Figure 6B:
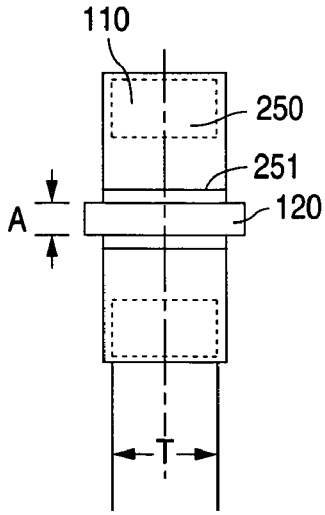

FIGS. 6*a* and 6*b* show side and edge views, respectively, of core 110 with margin tape 120, with the addition of a heat sink 250. Heat sink 250 includes a copper strap 251, having a width "W" slightly less, e.g., about 0.1 to 0.2 mm, than the thickness "T" of core 110. Strap 251 is inserted in a compressible, gap filling, silicon sleeve 253. Sleeve 253 is both thermally conductive and electrically insulating. The length of strap 251 is preferably substantially longer, preferably at least 2 mm, than the outer circumference of the toroid to enable heat to be conducted away from transformer 200, as explained below.

Figure 7:
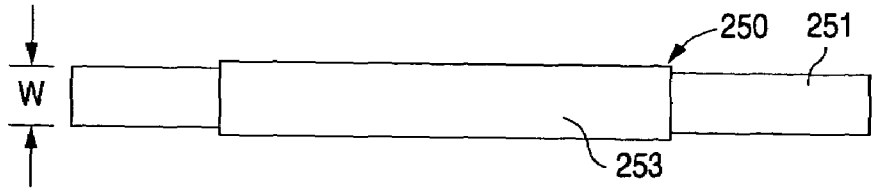
FIG. 7 shows a top view of the heat sink shown in FIG. 6 prior to being wrapped around the core of the toroidal transformer.

FIG. 7 shows a top view of the heat sink shown in FIG. 6 prior to being wrapped around the core of the toroidal transformer.

FIGS. 6*a* and 6*b* illustrate that strap 251 is wrapped substantially along the outer circumference of the toroid core 110 so as to form a cylindrical loop on the outer surface thereof, without covering the margin tape 120. Strap 251 is bent close to the margin tape 120, so that the two ends of strap 251 do not touch each other. Copper strap 251 is soft and thus will quickly take the shape of the outer circumference of the toroid, and can be held in place without much difficulty until the primary winding process is started.

Figure 8A:
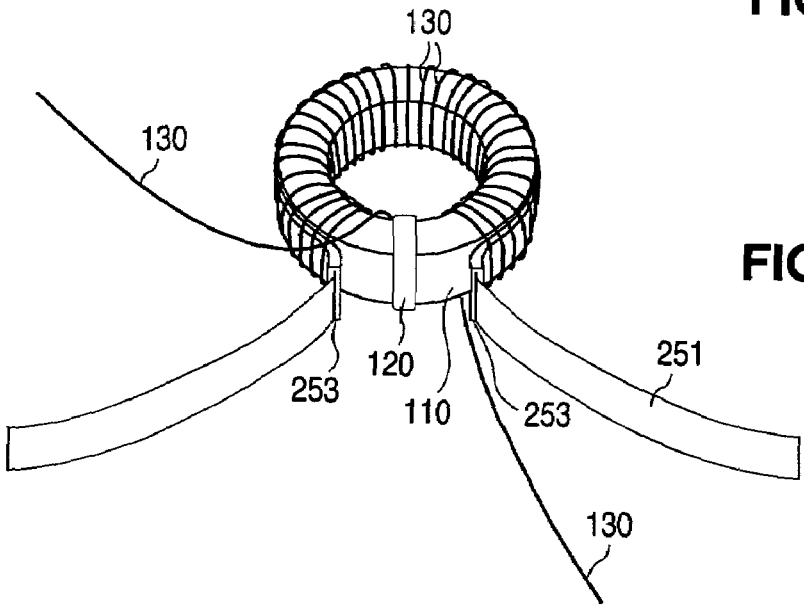
FIGS. 8*a* and 8*b* show two views of the heat sink and primary winding on the toroidal transformer shown in FIG. 6, where
Figure 8B:
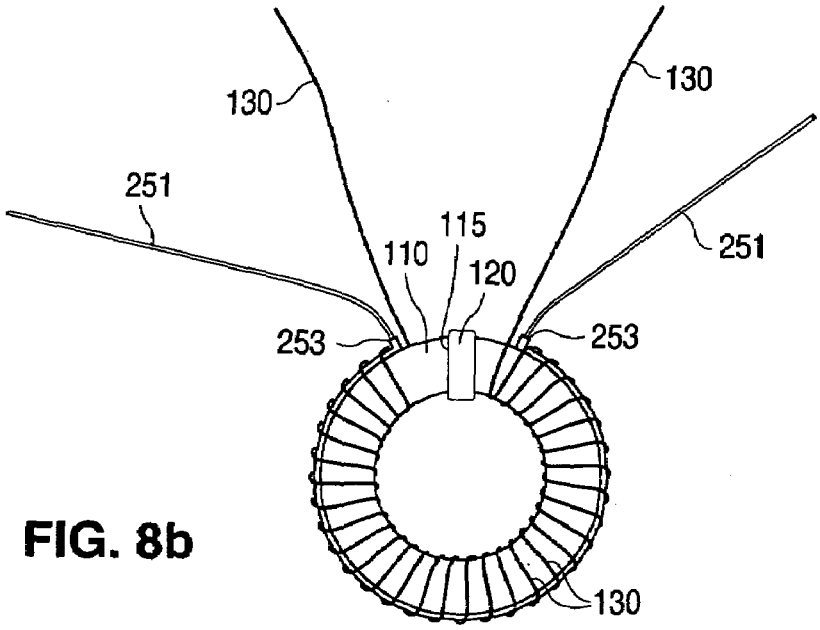

FIGS. 8*a* and 8*b* show two views of heat sink 250 and primary winding on second embodiment toroidal transformer 200, where FIG. 8*a* is a top and left side perspective view and FIG. 8*b* is a right side view. Primary winding 130 is wound tightly onto toroidal core 110, which also holds heat sink 250 in place. Primary winding 140 of the second embodiment is the same as that of the first embodiment, except that the second embodiment primary winding also winds about heat sink 250 as shown in FIGS. 8*a* and 8*b*. The compressibility of the thermally conductive silicon sleeve 253 fills the gaps between strap 251 and core 110 and the gaps in primary winding 130. In an alternative embodiment, another thermally conductive and electrically insulating tape could be applied on the copper strip. A filler, such as a conductive epoxy, may be needed to fill in the gaps. Secondary winding 140 is then prepared, as explained above with reference to the first embodiment, and is wound onto primary winding 130.

Figure 9A:
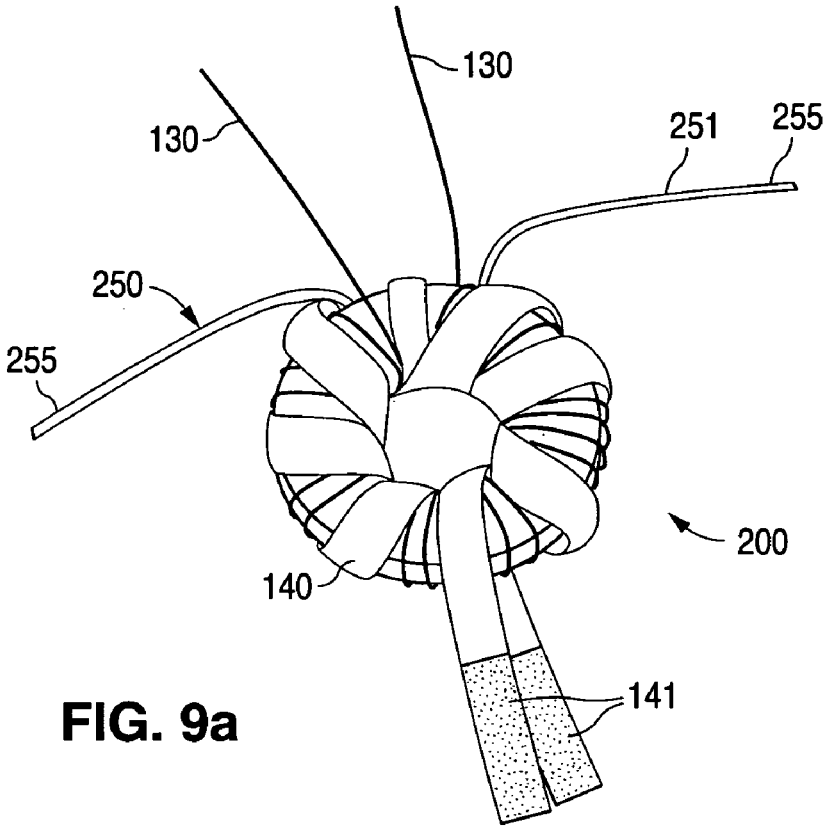
FIGS. 9*a* and 9*b* are left side and left side perspective views, respectively, of the second embodiment of a toroidal transformer according to the present invention.
Figure 9B:
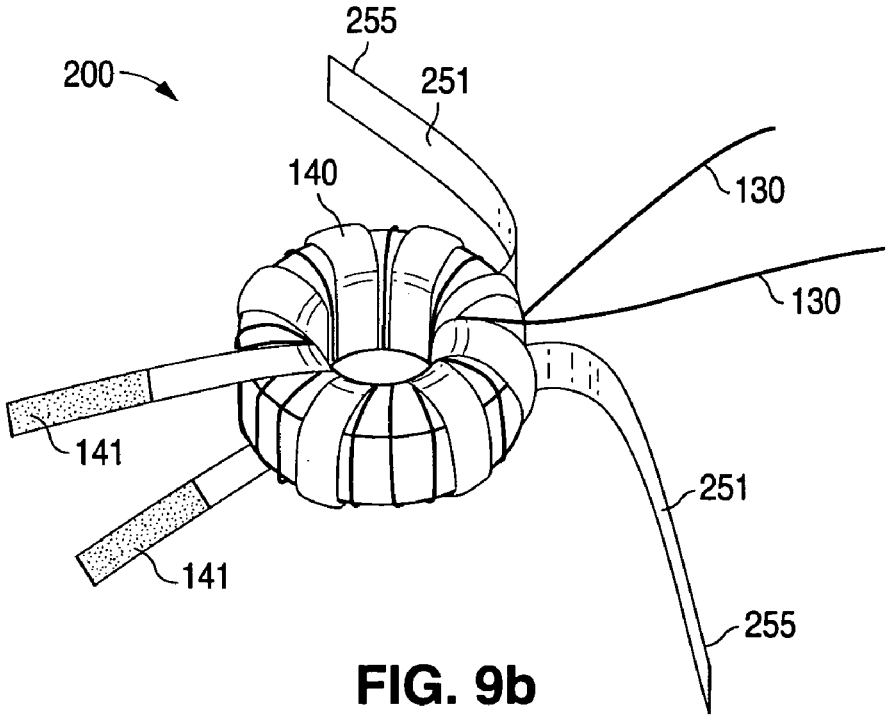

FIGS. 9*a* and 9*b* are side and perspective views, respectively, of finished toroidal transformer 200. Copper strap 251 protrudes from transformer 200 and provides cooling, as described below. Transformer 200 is particularly well suited for applications where additional cooling is required to maintain acceptable transformer temperatures.

Strap 251 is sandwiched between core 110 and primary winding 130 and serves as a heat sink 250. The exposed ends 255 of strap 251 can be arranged relative to air flow or attached to other heat sinks to enhance heat removal from transformer 200. In one embodiment, strap 251 is formed to intercept a cooling air flow for enhanced convection. In another embodiment, strap 251 acts as an integral part of the transformer and assists the cooling of the core as well as the winding. This technique also offers very low thermal impedance between the copper strap heat sink and the core and primary winding heat sources.

To summarize, the preferred steps of the method of constructing the second embodiment of the present invention include: (1) wrapping margin tape 120 around section 115 of coated core 110; (2) applying a thermally conductive, electrically insulating, compressible silicon sleeve 253 onto copper strap 251 to form heat sink 250; (3) wrapping the sleeve 253 portion of heat sink 251 around the outer circumference of core 110 so the exposed ends 255 of strap 251 extend from the outer circumference adjacent margin tape 120 on the top edge of core 110; (5) tightly winding primary winding 130 on core 110 with sleeved portion of heat sink 250 sandwiched between core 110 and primary winding 130; (6) applying a plurality of layers of reinforced insulating sleeve 143 onto a copper strip 141 to form secondary winding 140; and (6) wrapping the sleeved portion of secondary winding 140 over primary winding 130 to form a helix or spiral with the exposed ends of strip 141 extending from the outer circumference of core 110.

To enhance convective cooling, transformer 200 can alternatively be impregnated with a thermally conductive epoxy, and strap 251 can be clamped to an external heat sink for additional cooling. Care should be taken not to electrically short the two ends 255 of copper strap 251, as this may alter the performance of the transformer. To avoid shorting the ends of strap 251, two separate insulated heat sinks could be used for attaching to the two ends 255.

To enhance convective cooling, transformer 200 can alternatively be impregnated with a thermally conductive epoxy, and strap 251 can be clamped to an external heat sink for additional cooling. Care should be taken not to electrically short the two exposed ends 255 of copper strap 251, as this may alter the performance of the transformer. To avoid shorting the exposed ends of strap 251, two separate insulated heat sinks could be used for attaching to the two exposed ends 255.

Figure 10:
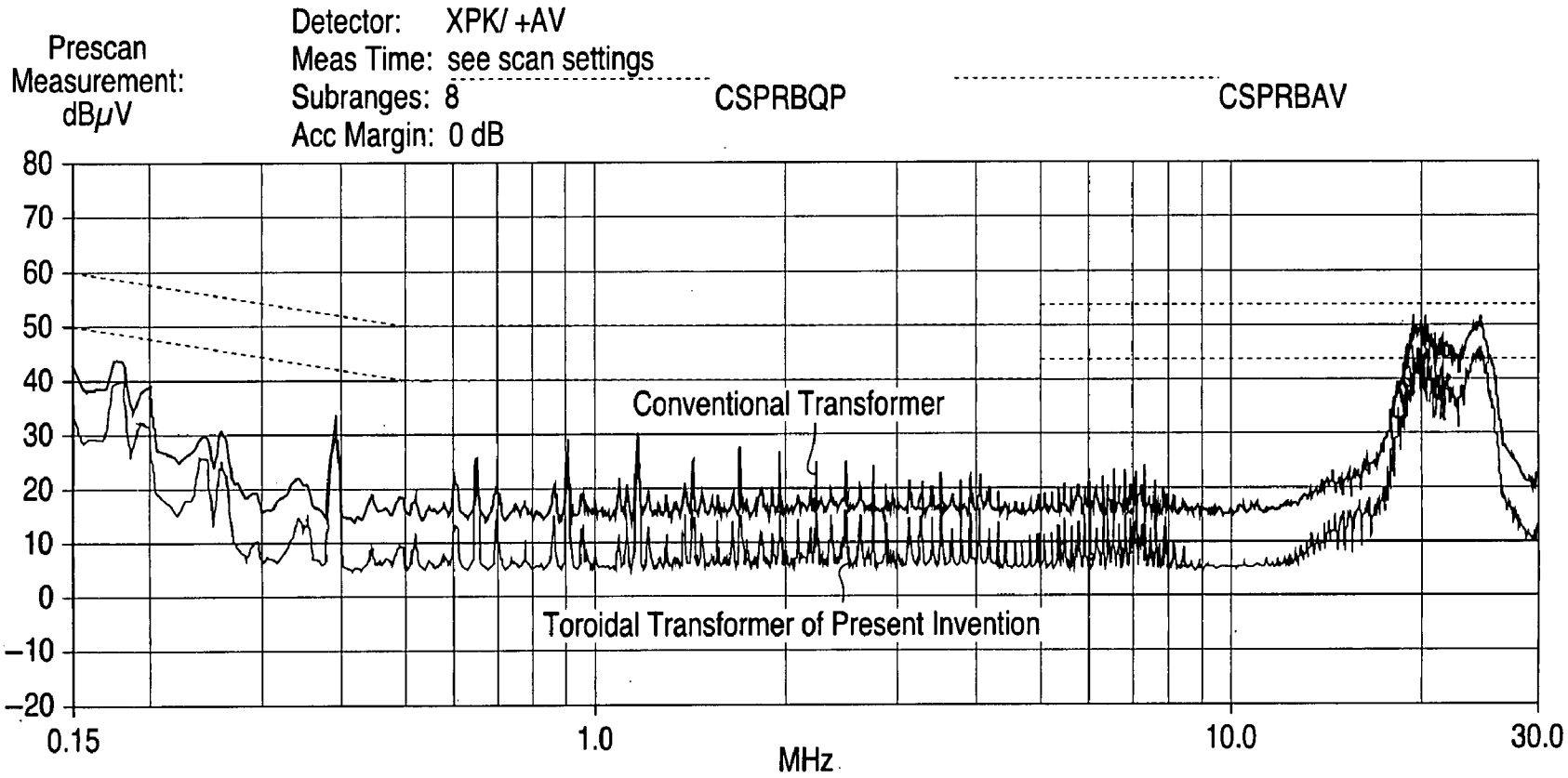
FIG. 10 is an EMI (electromagnetic interference) scan comparing the second toroidal transformer of the present invention to that of a conventional transformer.

A transformer constructed according to the above described second embodiment was built and tested in comparison with a prior art transformer. The transformer of the present invention was found to have a volume that is 50% lower than the prior art transformer, a cost of 60% less than the prior art transformer, and improved efficiency in a switching converter application. Importantly, as shown in the EMI scan of FIG. 10, the EMI generated by the toroidal transformer of the present invention showed improvement in all bands in comparison to the prior art tranfomer, with improvement in the low band and mid band of approximately 5 dB, while the improvement in the third band was more than 12 dB lower than the prior art transformer.

The inventive transformers are useful for many types of transformers, such as for transformers rated at 1 kW or higher. The toroidal transformers of the present invention could also be used in all forms of switching power supplies. The technique of cooling the toroidal magnetic part of the transformer using a strap heat sink can also be applied to power transformers, inductors as well as EMI filters. The copper strap heat sink technique described herein could be used in any application involving toroids including inductors, transformers and EMI components.

In addition to using a copper strap heat sink for cooling a transformer, as in transformer 200, the copper strap heat sink concept could also be used in conventional transformers, such as those that use bobbins and geometries like EE, EI, PQ, ETD, EC, RM, and other similar type of cores. Such a copper strap heat sink could be wound as one turn, placed at the required position inside the winding on the core. One end of such strap could extend outside the bobbin and then could be used as a cooling fin in forced cooled application or could be clamped on an external heat sink in convection cooled applications.

Having disclosed exemplary embodiments, modifications and variations may be made to the disclosed embodiments while remaining within the scope of the invention as described by the following claims.

What is claimed is:

1. A transformer comprising: a toroidal core; a primary winding wrapped about the toroidal core as a spaced single layer of wire; a secondary winding wrapped about the primary winding to form a helix, and a margin tape applied around a section of said toroidal core with its upper surface forming a top edge of said core and wherein a single layer of magnet wire is wrapped around the core on either side of said margin tape to form said primary winding.

2. The transformer of claim 1 wherein said margin tape has a width that is a function of the working voltage applied across the primary winding and a thickness that exceeds the thickness of said primary winding.

3. The transformer of claim 2 wherein the thickness of said primary winding is in the range of about 0.5 to about 4 mm.

4. A transformer comprising: a toroidal core; a primary winding wrapped about the toroidal core as a spaced single layer of wire; and a secondary winding wrapped about the primary winding to form a helix; wherein said secondary winding is a copper strip coated with at least one layer of insulation.

5. The transformer of claim 4 wherein said copper strip has a thickness of T and a width of X such that X/T is in the range of about 5 to about 30.

6. The transformer of claim 4 wherein the copper strip is coated with at least three layers.

7. A transformer comprising: a toroidal core having its outer circumference forming an approximately cylindrical surface; a heat sink wrapped substantially along said cylindrical surface, where said heat sink includes a copper strap having an electrical insulation that is thermally conductive; a primary winding wrapped about the heat sink, and a secondary winding.

8. The transformer of claim 7 wherein said secondary winding is wrapped about said primary winding.

9. The transformer of claim 7 further comprises a margin tape applied around a section of said toroidal core with its upper surface forming a top edge of said core and a single layer of magnet wire is wrapped around the core to form said primary winding on either side of said margin tape.

10. The transformer of claim 9 wherein the portion of said copper strap having the electrical insulation is wound around the outer circumference of said core without covering said margin tape and the exposed ends of the copper strap extend from the outer circumference adjacent the margin tape on the top edge of said core.

11. The transformer of claim 10 wherein the length of said copper strap is substantially longer than the outer circumference of said core to provide a greater flow of heat to be conducted away from the transformer.

12. The transformer of claim 10 wherein the width of said copper strap is slightly less than the thickness of the core.

13. The transformer of claim 12 wherein the electrical insulation is a silicon sleeve.

14. The transformer of claim 9 further comprising a secondary winding wrapped about said primary winding.

15. The transformer of claim 14 wherein said secondary winding is wrapped over said primary winding in the form of a helix.

16. A method of constructing a transformer comprising the steps of: (1) wrapping a margin tape around a section of a toroidal core; (2) wrapping a heat sink around the outer circumference of said toroidal core, where said heat sink includes a copper strap having an electrical insulating, thermally conductive sleeve covering that portion of said heat sink in contact with the core and having the exposed ends of said strap extend from the outer circumference of said core; (3) winding a primary winding on said core with the sleeved portion of said heat sink sandwiched between said core and said primary winding; and (4) wrapping a secondary winding over said primary winding.

17. The method of claim 16 wherein said secondary winding comprises a plurality of layers of reinforced insulating sleeve applied onto said copper strip.

18. The method of claim 17 wherein the exposed ends of said copper strap extend from the outer circumference of said core adjacent said margin tape.

19. The method of claim 17 wherein said secondary winding is wrapped over said primary winding in the form of a helix.

* * * * *